US006543069B1

(12) United States Patent
Nelson

(10) Patent No.: US 6,543,069 B1
(45) Date of Patent: Apr. 8, 2003

(54) EXTENDING DISH DRAIN RACK

(76) Inventor: Annie L. Nelson, 1060 W. 80th St., Los Angeles, CA (US) 90044

( * ) Notice: Subject to any disclaimer, the term of this patent is extended or adjusted under 35 U.S.C. 154(b) by 123 days.

(21) Appl. No.: 09/800,693

(22) Filed: Mar. 6, 2001

Related U.S. Application Data

(60) Provisional application No. 60/191,917, filed on Mar. 24, 2000.

(51) Int. Cl.[7] ..... A47J 47/20

(52) U.S. Cl. ..... 4/656; 211/41.3; 211/41.5; D32/56

(58) Field of Search ..... 4/656, 637; 211/41.3, 211/41.5, 41.4; D32/56, 55

(56) References Cited

U.S. PATENT DOCUMENTS

| | | | | | |
|---|---|---|---|---|---|
| 958,857 | A | * | 5/1910 | Dennis | 4/656 X |
| 1,522,921 | A | | 1/1925 | Smiley | |
| 1,835,232 | A | | 12/1931 | Lord | |
| 3,025,967 | A | * | 3/1962 | Christophersen | 211/41.5 |
| 4,169,638 | A | | 10/1979 | Cirasuolo et al. | |
| D267,125 | S | | 11/1982 | Luoma | |
| 4,372,448 | A | | 2/1983 | Drach | |
| 4,480,343 | A | | 11/1984 | Drach | |
| 4,531,641 | A | * | 7/1985 | Archambault | 211/41.3 |

* cited by examiner

*Primary Examiner*—Michael Powell Buiz
*Assistant Examiner*—Kathleen J. Prunner
(74) *Attorney, Agent, or Firm*—Norton R. Townsley; Belasco Jacobs & Townsley, LLP

(57) ABSTRACT

An extendible dish drain rack comprising a plurality of bases designed to assemble in a particular sequence; the front of the second and each subsequent base designed to overlap the rear of the preceding base with a short overlap. A lip for overlapping a sink is provided at the front of the first. A first fastener is located at the front of each second and subsequent base. A second fastener is located at each rear. The fasteners are designed to mate with each other, prevent slippage and allow for disassembly of the bases. Each base also incorporates a device for inclining the bases. This creates an angle of inclination in the assembly sufficient to efficiently drain water. There are typical supports for supporting dishes in a water draining configuration on the top surface of each base. Preferably the device for inclining the bases is a foot or leg located under the rear of each base. Preferably one fastener is a slot and the second fastener is a tab which loosely fit to each other.

9 Claims, 1 Drawing Sheet

EXTENDING DISH DRAIN RACK

REFERENCE

The applicant claims the benefit of Disclosure Document no. 462,220, filed Oct. 6, 1999 and Provisional Application No. 60/191,917, filed Mar. 24, 2000.

BACKGROUND OF THE INVENTION

The present invention relates to the field of drain racks and more particularly to drain racks that can extend to cover a longer kitchen counter.

The standard method of washing cutlery, dishes, cups, saucers, glasses, pots, pans, etc. (which will be collectively designated dishes in this document) includes washing the items in hot, soapy water, rinsing them in hot, clean water and placing them into a drying rack placed on the kitchen counter adjacent to the sink. The dishes may be allowed to air dry in the rack or may be taken from the rack when only partially dry and dried with a towel. Standard dish drain racks are designed with inclines and lips so that, when placed with the lip over the edge of the sink, water dripping off the dishes etc. drains into the sink for convenient discharge into the sanitary sewer connected to the sink.

When a lot of dishes need to be washed, several racks may be needed. However, in many cases, only one may be placed with its lip over the edge of the sink. Then water accumulates on the counter. What is needed is a dish drain rack that is extendible and that allows water from any part of the rack to drain into the sink.

Several inventors have invented improvements in the standard dish drain rack. U.S. Pat. No. 1,522,921 discloses a drain mat composed of a plurality of rectangular frames with wire coils to support dishes and lift the mat above the surface on which it stands, joined together by another wire coil. U.S. Pat. No. 1,835,232 discloses a drain rack having a lower, slanted member and an upper member composed of a series of slats, attached together with a hinge. U.S. Pat. No. 4,169,638 discloses an extendible drain rack having three sections which can slide inside each other. The three sections have slanted tops and are of different heights. U.S. Pat. No. 4,372,448 discloses a device that can be used as a dish drain rack in one orientation and a cutting, washing board in the inverse orientation. U.S. Pat. No. 4,480,343 discloses a combination drain and cutting board for use with a dish rack. U.S. Pat. No. D267,125 discloses a drain board of the specific design illustrated.

However, none of the above innovations solves the problem outlined above. Development of a dish drain rack which can extend for drying of a large quantity of dishes and drain water from all sections to the sink represents a great improvement in the field of drain racks and satisfies a long felt need of the homemaker.

SUMMARY OF THE INVENTION

The present invention is an extendible dish drain rack comprising: a first section which provides support at an angle of inclination sufficient to effectively and efficiently drain water and a second section which also provides support at an angle of inclination equal to the angle of inclination of the first section. Each section has an essentially flat base and a rear leg or foot. At the front of the first section is a lip which is designed to overlap the rim of a sink. The second section is designed so that its front overlaps and rests on the rear of the first section and its angle of inclination is the same as the angle of inclination of the first section. To accomplish this, the leg or foot of the second section must be taller than the leg or foot of the first section. It will be appreciated that the exact dimensions can easily be derived from simple trigonometry once the angle of inclination, the lengths of the sections, and the overlap distances have been decided. There is also provided a mechanism for removably interconnecting the front of the second base to the rear of the first base. Thus water can drain from the rear of the second section to the front of the first section, i.e. all the way into the sink. This creates an essentially water tight joint between the two sections. In typical fashion there are a number of supports on the top surfaces of both sections for holding dishes in a water draining configuration. Clearly, further sections similar to the second section can be added. Each additional section must simply have a taller foot or leg than the preceding one. Again, the exact dimensions can be derived trigonometrically as described above.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

Figure 1:
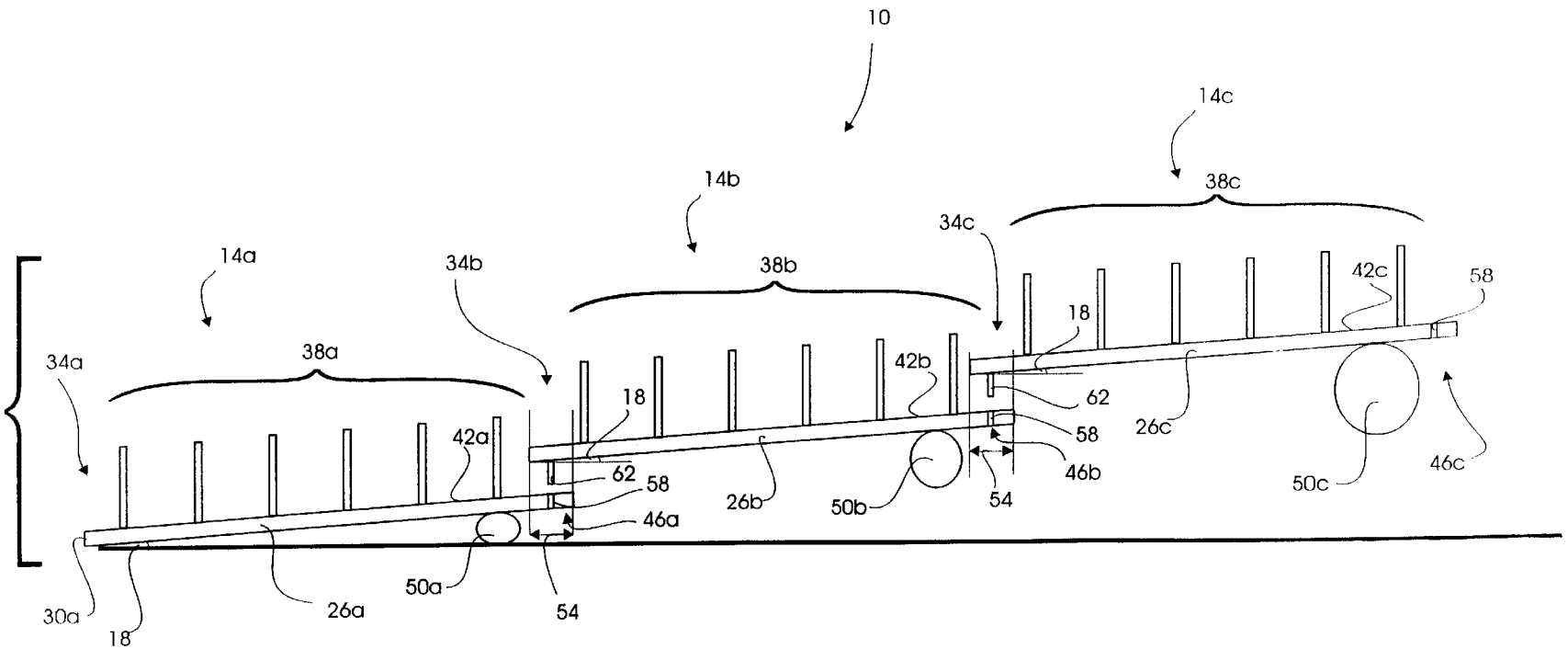
FIG. 1 is an exploded side view of an embodiment of this invention having three sections.

FIG. 1 is an exploded side view of an embodiment of this invention having three sections 14*a*, 14*b*, 14*c*. The first section has an inclined base 26*a* with a lip 30*a* at its front 34*a* and support members 38*a* for supporting dishes in a water draining configuration on its top surface 42*a*. The angle of inclination 18 is sufficient to effectively and efficiently drain water from the rear 46*a* to the front 34*a* and is preferably provided by a foot or leg 50*a* under the rear 46*a* of the base 26*a*. The second section 14*b* has an inclined base 26*b* with support members 38*b* for supporting dishes in a water draining configuration on its top surface 42*b*. The angle of inclination 18 of the second base 14*b* is the same as the angle of inclination 18 of the first base 14*a* and is also preferably provided by a foot or leg 50*b* under the rear of the base 14*b*. However, this second foot or leg 50*b* is taller than the foot or leg 50*a* under the first base 14*a*.

The rear 46*a* of the first section 14*a* and the front 34*b* of the second section 14*b* are designed to mate with an essentially watertight connection. One way of providing this is to provide for a slight overlap 54 of the second base 26*b* over the first base 26*a*. In order to prevent the second base 26*b* from slipping off the first base 26*a*, a disassemblable connection is provided at the overlap 54. This can preferably be a system of loosely fitting slots 58 and tabs 62. In this way water will drain all the way from the rear 46*b* of the second base 26*b* to the front 34*a* of the first base 26*a*, and then into the sink (not illustrated) by gravity, similar to the way water drains off the tiles of a roof. Also, the sections 14*a*, 14*b* can be easily disassembled for storage.

A third 14*c* and subsequent 14*n* sections (not illustrated) can also be provided. The design of the third section 14*c* is identical to that of the second section 14*b*, including the slots 58, tabs 62 and overlap 54, except that the foot or leg 50*c* is taller in order to continue the selected angle of inclination 18. The design of subsequent sections 14*n* is also identical to that of the second 14*b* and third 14*c* sections with even taller legs or feet 50*n*. The exact dimensions can easily be derived from simple trigonometry once the angle of inclination 18, the lengths of the sections 14*a*, 14*b* . . . 14*n*, and the overlap distances 54 have been decided. It will readily be appreciated that the exact configurations of the dish draining supports 38*a*, 38*b*, 38*c* are a matter of design choice and can be varied on each section.

The following reference numerals are used on FIG. 1. The suffixes a, b and c are used to designate features only associated with the first, second and third sections of the invention, respectively.

10 Extending dish drain rack
14*a* First section
14*b* Second section
14*c* Third section
18 Angle of inclination
26*a* Base of first section
26*b* Base of second section
26*c* Base of third section
30*a* Lip at front of first section
34*a* Front of first base
34*b* Front of second base
34*c* Front of third base
38*a* Dish drain supports of first section
38*b* Dish drain supports of second section
38*c* Dish drain supports of third section
42*a* Top of first base
42*b* Top of second base
42*c* Top of third base
46*a* Rear of first base
46*b* Rear of second base
46*c* Rear of third base
50*a* Foot or leg of first section
50*b* Foot or leg of second section
50*c* Foot or leg of third section
54 Overlap
58 Slot
62 Tab The extendible dish drain rack 10 has been described with reference to a particular embodiment. Other modifications and enhancements can be made without departing from the spirit and scope of the claims that follow.

What is claimed is:

1. An extendible dish drain rack comprising:

a. a plurality of bases; each of said bases having a top and a rear; each of said bases being designed to be assembled and disassembled front to rear, with a short overlap, with an angle of inclination sufficient to efficiently drain water, in a particular sequence;

b. a lip adapted to overlap a sink is provided at the front of the first of said plurality of bases; and c. a plurality of supports adapted for supporting dishes are provided on said tops of said bases.

2. An extendible dish drain rack as claimed in claim 1 in which the angle of inclination is formed by a plurality of legs of increasing height attached under the rear of each base.

3. An extendible dish drain rack comprising:

a. a plurality of base means for providing support; each of said base means having a front, a rear and a top; each of said base means is designed to assemble in a particular sequence; the front of the second and each subsequent of said base means is designed to overlap the rear of the preceding base means with a short overlap;

b. a lip means for overlapping a sink is disposed at the front of the first of said base means;

c. a first disassemblable fastening means located at the front of said second base means and each subsequent base means;

d. a second disassemblable fastening means located at each rear of said plurality of base means; said first fastening means and said second fastening means being designed to mate with each other, prevent slippage and allow for disassembly;

e. an inclining means attached to each of said base means for creating an angle of inclination sufficient to efficiently drain water when said base means are assembled in said particular sequence by the mating of said first and second disassemblable fastening means at said overlap; and f. a plurality of support means for supporting dishes on said tops.

4. An extendible dish drain rack as claimed in claim 3 in which said inclining means comprises a foot located under said rear of each of said base means.

5. An extendible dish drain rack as claimed in claim 3 in which said first disassemblable fastening means is a tab and said second disassemblable fastening means is a slot.

6. An extendible dish drain rack comprising:

a. a plurality of bases; each of said bases having a front, a rear and a top; said bases being designed to assemble in a particular sequence; the front of the second and each subsequent of said bases is designed to overlap the rear of the preceding base with a short overlap;

b. a lip for overlapping a sink is provided at the front of the first of said bases;

c. a first disassemblable fastener located at the front of said second base and each subsequent base;

d. a second disassemblable fastener located at each rear of said plurality of bases; said first and second disassemblable fasteners being designed to mate with each other, prevent slippage and allow for disassembly;

e. an inclining means attached to each of said bases for creating an angle of inclination sufficient to efficiently drain water when said bases are assembled in said particular sequence by the mating of said first and second disassemblable fasteners at said overlap; and f. a plurality of supports adapted for supporting dishes on said tops.

7. An extendible dish drain rack as claimed in claim 6 in which said inclining means comprises a foot located under said rear of each of said bases.

8. An extendible dish drain rack as claimed in claim 6 in which said first disassemblable fastener is a tab and said second disassembleble fastener is a slot.

9. A method of fabricating an extendible dish drain rack comprising:

a. fabricating a plurality of bases; each of said bases having a front, a rear and a top; said bases being designed to assemble in a particular sequence; the front of the second and each subsequent of said bases is designed to overlap the rear of the preceding base with a short overlap;

b. fabricating a lip for overlapping a sink at the front of the first of said bases;

c. incorporating a first disassemblable fastener at the front of said second base and each subsequent bases;

d. incorporating a second disassemblable fastener at each rear of said plurality of bases; said first and second disassemblable fasteners being designed to mate with each other, prevent slippage and allow for disassembly;

e. incorporating an inclining means on each of said bases for creating an angle of inclination sufficient to efficiently drain water when said bases are assembled in said particular sequence by the mating of said first and second disassemblable fasteners at said overlap;

f. fabricating a plurality of supports adapted for supporting dishes;

g. attaching said plurality of supports on said tops.

* * * * *